United States Patent [19]

Briles et al.

[11] 4,278,115

[45] Jul. 14, 1981

[54] DEVICE FOR CAPTURING AND RETAINING SPILT FLUIDS

[76] Inventors: Wallace E. Briles, 309 Yoakum Pkwy., Apt. 506, Alexandria, Va. 22304; Robert W. Dubin, 11508 E. Maple Ave., Beltsville, Md. 20705

[21] Appl. No.: 63,747

[22] Filed: Aug. 6, 1979

[51] Int. Cl.[3] ..... B65B 3/06

[52] U.S. Cl. ..... 141/86; 141/98; 52/20; 137/312; 138/89; 285/205; 277/189; 277/212 FB

[58] Field of Search ..... 141/85–88, 141/285–310, 115, 59, 98, 392; 137/312–314, 364, 371; 285/42, 43, 44, 192, 205; 138/89; 4/286, 293, 295; 52/19, 20, 21; 277/212 FB, 189

[56] References Cited

U.S. PATENT DOCUMENTS

| | | | |
|---|---|---|---|
| 1,299,423 | 4/1919 | Bropson | 285/42 |
| 2,564,871 | 8/1951 | Wikman | 141/59 |
| 2,893,423 | 7/1959 | Seney | 137/371 |
| 3,633,219 | 1/1972 | Byrd | 4/10 |
| 3,662,794 | 5/1972 | Turner | 141/290 |
| 3,672,403 | 6/1972 | Wilson et al. | 138/89 |
| 3,908,718 | 9/1975 | Bower | 141/59 |
| 3,977,137 | 8/1976 | Patry | 285/42 |
| 4,076,040 | 2/1978 | Alpers et al. | 137/371 |
| 4,094,346 | 6/1978 | Milo | 141/286 |

FOREIGN PATENT DOCUMENTS

| | | | |
|---|---|---|---|
| 231568 | 12/1909 | Fed. Rep. of Germany | 141/115 |
| 32043 | 3/1927 | France | 141/86 |
| 1022519 | 12/1952 | France | 137/364 |

*Primary Examiner*—Houston S. Bell, Jr.
*Attorney, Agent, or Firm*—Blair, Brown & Kreten

[57] ABSTRACT

Disclosed herein is a device for capturing and retaining fluids such as gasoline which is split while filling a main storage tank, for example, in a gas station. The device includes a manhole having a floor through which the fill pipe for the main storage tank extends, an auxiliary or holding tank communicating with the manhole, and a valve and conduit associated with the holding tank to provide a fail-safe operation of the holding tank. Further, the main fill pipe is provided with a gasket at the juncture where it passes through the manhole floor constructed in such a manner that the standpipe can translate vertically within the hole disposed on the manhole floor due to seasonal change while the integrity of the gasket is still maintained.

9 Claims, 2 Drawing Figures

DEVICE FOR CAPTURING AND RETAINING SPILT FLUIDS

BACKGROUND OF THE INVENTION

The current structure associated with fluid tanks in service stations comprises a storage tank having a fill pipe disposed below a manhole for the reception of fluids to be used at the pumps. Also included are various venting means and vapor recovery systems to be sure that the pressure within the storage tanks does not become excessive nor do the vapors re-enter the atmosphere.

Patents which fall within these classifications comprise the following five:

U.S. Pat. No. 2,564,871 Wikman
U.S. Pat. No. 3,633,219 Byrd
U.S. Pat. No. 3,662,794 Turner
U.S. Pat. No. 3,908,718 Bower
U.S. Pat. No. 4,094,346 Milo Curiously, however, none of these patents contemplate nor provide for the situation where the main storage tank has been filled to the maximum capacity and there is still a quantity of fluid within the hose that extends from the transport truck to the standpipe. Human nature being what it is, and given the fact that the transport truck uses gravity feed into the main storage tank, the excess fluid within the hose is usually disposed of by shutting off the valve at the transport truck and disconnecting the coupling between the hose and the standpipe. This of course causes the fluids to run around the storage tank and into underground streams around sewer conduits, etc., and in general, deposits this fluid into the ground. Therefore, these liquid fuels seep into the ground to underground natural drainage systems or overflow into storm drains eventually flowing into rivers or other natural waterways. In addition, however, such fluids that eventually flow into natural waterways pollute. Some, of course, will evaporate and therefore, pollute the air.

Equally objectionable is the volatility of these fluids which, should they migrate to certain areas, provide fire hazards. For example, such fluids have been known to seep into the basements of adjoining buildings and be ignited by machinery located in boiler rooms, etc.

Further, the necessity of conserving these liquids has become more critical to such an extent that such waste is no longer tolerable.

SUMMARY OF THE INVENTION

Accordingly, an object of this invention is to provide a device which should the main storage tank be filled up to capacity, allows the surplus fluid to flow into an auxiliary storage tank and not pollute the environment.

A further object contemplates providing a device of the character described above which requires no additional manipulation or effort on the part of the person filling the main storage tank so as to assure that spillage into the environment will not occur.

A further object contemplates providing a device which is relatively easy to install, and simple to maintain.

It is yet a further object of this invention to provide a device of the character described above in which the fluid thus spilled can be reclaimed.

Another object contemplates providing a device which will preclude the possibility of any type of spill of this nature occurring and therefore providing damage to the environment either through evaporation into the air or contamination of water systems and the like.

It is still a further object of this invention to provide a system which eliminates the fire hazards which have heretofore existed.

Additionally, it is an object of this invention to provide a system which eliminates wasting of these fluids.

These and other objects will be made manifest when considering the following detailed description of the preferred embodiment when taken in conjunction with the appended drawings.

BRIEF DESCRIPTION OF THE PREFERRED EMBODIMENT

Figure 1:
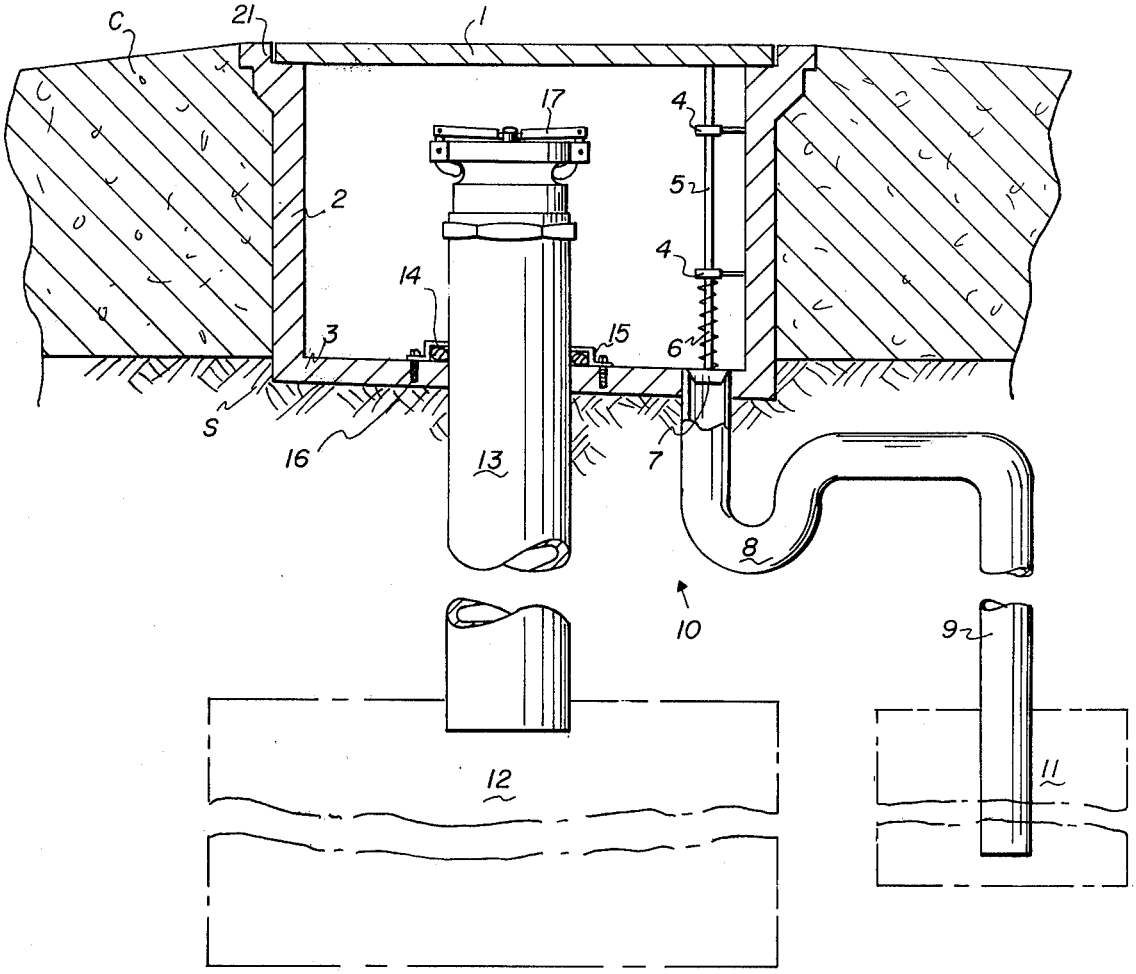
FIG. 1 is a side view perspective of the apparatus according to the present invention.

Referring to the drawing now, wherein like reference numerals refer to like parts throughout the several drawings, reference numeral 10 is directed to the device for capturing and retaining spilt fluid according to the present invention.

This device 10 is comprised of a well or manhole having a manhole cover 1 which nests upon an enclosed sidewall 2 through a step portion 21. The manhole has a floor 3 which slopes in a manner to be explained hereinafter. The manhole itself is imbedded in concrete and the substrate disposed below the concrete is traditionally formed from sand. Extending through a central portion of the manhole floor 3 is a standpipe or fill pipe 13 having a conventional gas cap 17 disposed on the vertical extent thereof, and this fill pipe 13 communicates with the primary or main storage tank 12.

As mentioned above, the floor 3 of the manhole 3 has a sloping contour which causes any liquids accumulated with the well to congregate to one side thereof, and the low point on the manhole floor is provided with a conduit or drain pipe 9 having a vapor trap 8 disposed thereon to retard the egress of vapors from an auxiliary or holding tank 11 communicating therewith. That is, a liquid level will remain in the U-shaped vent portion of the drain pipe 9 and so retard the egress of vapors to a very high degree.

A terminal portion of the drain pipe 9 proximate to the manhole floor 3 is provided with a sealing valve 7 connected to a rod 5 which is supported along a sidewall thereof by means of at least one guide ring 4. The guide ring 4 is defined by a loop having an outwardly extending rail secured to the manhole wall 2, and the terminal portion of rod 5 abuts against the manhole cover 1.

When the manhole cover 1 is removed, a spring 6 disposed between one guide ring 4 and the valve seal plug 7 acts in its normal state to compress itself so that when the constraint on the manhole cover 1 on the extremity of the rod 5 is removed, the valve will retract upwards exposing the access port for tl hr9ain pipe 9 into the holding tank 11.

In use and operation, the driver of the transport truck will effect a coupling with the fill pipe 13 by removing its cap 17, placing the discharge conduit thereover, and fill the tank 12. Frequently, the amount of fluid to be distributed within a storage tank is estimated prior to the actual installation, and the transport truck is provided with the expected amount of fluid when the delivery is to be made. In some cases, the estimate for the amount of fluid that the main storage tank will require exceeds the actual available volume that the tank 12 can receive, and so therefore before the entire contents of the truck have been exhausted, the storage tank will have been filled. At this point, since the feed operation is by gravity, the driver would find it extremely difficult to take the gasoline within the conduit and return it to the storage tank of the truck. With the apparatus according to the present invention, by shutting off the valve at the truck, and disconnecting the coupling between the fill pipe and the hose, the excess fluid will run into the manhole, be retained thereby and cause same to drain and be stored within the holding tank 11 as is evident from the drawings. The storage tank 12 and the holding tank 11 can be provided with appropriate venting means which does not form a portion of this invention. Further, the holding tank 11 can conceivably be hooked up in such a fashion that the fluid contained within the holding tank can be used directly, or alternatively, the fluid can be extracted from the holding tank and put into the main storage tank for pumping or, a third alternative would include pumping out the holding tank, sending same back to the refinery for further purification if necessary.

The volume of the holding tank is such that it is not expected to provide a main storage facility, but rather be able to absorb the twenty and thirty gallon increments commonly wasted in the past as described above, and a small tank of adequate dimensions could provide adequate storage facilities so that this tank would only have to be emptied at infrequent intervals.

Attention is now directed to the gasket or sealing means which form a part of the invention since a good seal must be maintained between the vertical fill pipe 13 of the storage tank 12 and the manhole if seepage out into the environment is to be avoided. Further, it is to be noted that expansion and contraction caused by seasonal change, ground heaving, and the like will cause movement of the standpipe relative to the well in a vertical direction. Therefore, the gasket that surrounds the standpipe must be constructed in such a manner that this vertical translation can take place without compromising the integrity of the manhole system.

FIG. 1 discloses one form of a gasket in which a flange member 15 overlies an annular O-ring or gasket 14 placed in registry with the vertical walls of the fill pipe 13 and abuts against the floor of the manhole so that a tight seal between the fill pipe and the opening in the manhole floor can be assured. The flange 15 has a base portion which is fastened to the floor 3 of the manhole, a vertically upstanding portion connected thereto and a further horizontal portion somewhat defining a stepway under which the gasket 14 lies.

Figure 2:
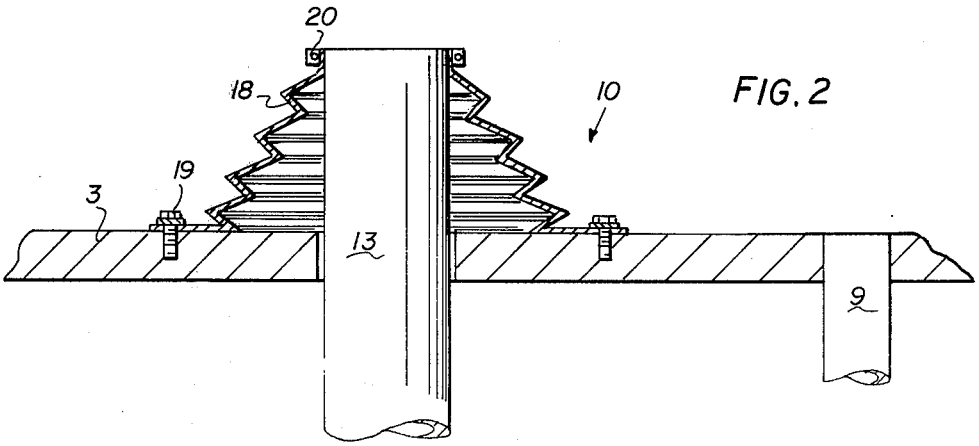
FIG. 2 is an alternative embodiment for a gasket sealing device depicted in FIG. 1.

FIG. 2 depicts another form of the gasket which would be suitable in which a collar or boot 18 is fastened at one extremity to the fill pipe 13 through a clamp 20 and at the other extremity to the floor 3 of the manhole so that this neoprene boot in a preferred embodiment can translate vertically upward and downward. The boot 18 is formed so that there is an accordion type effect and the width of the gasket decreases as a function of increasing height as shown in the drawings. Annular creases and indentations provide a serrated type of appearance when taken in cross-section, and because of the accordion effect the gasket can withstand vertical translation of the fill pipe 13 relative to the floor 3 of the manhole without any abrasion or compromise as to the sealing benefits and effects of the gasket.

Having thus described the invention it should be apparent that numerous structural modifications are contemplated as being part of this invention as set forth herein above and as defined herein below by the claims.

What is claimed is:

1. A device for capturing and retaining fluid spilled while filling a main storage tank having a fill pipe comprising, in combination, a manhole including a floor having an opening and a side wall defining an interior, said manhole having an open upper end for access to said manhole interior, said fill pipe extending upwardly from said main storage tank into said manhole interior through said floor opening for access through said manhole open end, means for sealing the intersection between said fill pipe and said manhole floor opening, said sealing means being adapted to permit relative movement between said fill pipe and said manhole floor, a holding tank, a drain pipe having a lower end communicating with said holding tank and an upper end opening into said manhole floor whereby fluid spilt onto said manhole floor during the filling of said main storage tank flows into said drain pipe upper end, down said drain pipe and into said holding tank.

2. The device of claim 1 further including valve means in said manhole interior for opening and closing said drain pipe upper end.

3. The device of claim 2 including a removable manhole cover for closing said manhole open end and wherein said manhole cover is operatively associated with said valve means whereby said valve means opens said drain pipe upper end wnen said manhole cover is removed and whereby said valve means closes said drain pipe upper end when said manhole cover is replaced.

4. The device of claim 3 which said valve means comprises a rod, a seal plug at one end of said rod which closes said drain pipe upper end, another end of said rod abuts against said manhole cover and biasing means on said rod which causes the said seal plug to open said drain pipe upper end.

5. The device of claim 4 in which said rod is supported by at least one guide ring fastened to said manhole side wall, and said biasing means extends between said guide ring and said seal plug.

6. The device of claim 5 wherein said manhole floor is sloped toward said drain pipe upper end.

7. The device of claim 6 in which said drain pipe has a "U" shaped bend which serves as a vapor lock.

8. The device of claim 7 which said sealing means comprises an annular ring about the fill pipe fastened to said floor by a flange whereby said fill pipe can translate vertically and still provide a seal.

9. The device of claim 7 in which said sealing means comprises a corrugated boot fastened to said floor and said fill pipe through flange means whereby said fill pipe can translate vertically.

* * * * *